United States Patent [19]

Merker et al.

[11] 4,177,131

[45] Dec. 4, 1979

[54] METHOD FOR OBTAINING BRIGHT ZINC AND CADMIUM ELECTROPLATES USING CARBOXAMIDE ADDITIVES

[75] Inventors: Reuven Merker, Englewood Cliffs; Salvatore Lucca, Paramus, both of N.J.

[73] Assignee: The Metalux Corporation, Carlstadt, N.J.

[21] Appl. No.: 927,419

[22] Filed: Jul. 24, 1978

Related U.S. Application Data

[63] Continuation-in-part of Ser. No. 835,296, Sep. 21, 1977, abandoned, which is a continuation-in-part of Ser. No. 688,270, May 20, 1976, abandoned.

[51] Int. Cl.[2] ..... C25D 3/24; C25D 3/28

[52] U.S. Cl. ..... 204/50 Y; 204/55 Y

[58] Field of Search ..... 204/50 R, 50 Y, 55 R, 204/55 Y

[56] References Cited

U.S. PATENT DOCUMENTS

| | | | |
|---|---|---|---|
| 2,383,798 | 8/1945 | Hull | 204/50 Y |
| 3,318,787 | 5/1967 | Rindt et al. | 204/55 Y |
| 3,411,996 | 11/1968 | Rushmere | 204/50 Y |

*Primary Examiner*—Howard S. Williams

[57] ABSTRACT

The addition of an inner salt of a quaternized pyridine carboxamide, preferably 1-benzyl pyridinium-3-carboxamide to aqueous alkaline electroplating baths containing zinc and cadmium ions results in smooth, bright deposits of these metals. High plating efficiency with low consumption of the additive compound is obtained using it either alone or in combination with small amounts of nicotinamide.

15 Claims, No Drawings

METHOD FOR OBTAINING BRIGHT ZINC AND CADMIUM ELECTROPLATES USING CARBOXAMIDE ADDITIVES

This is a continuation-in-part of application Ser. No. 835,296 filed Sept. 21, 1977 which is in turn a continuation-in-part of application Ser. No. 688,270 filed on May 20, 1976, both now abandoned, by the same inventors and assigned to same assignee.

FIELD OF THE INVENTION

The present invention relates to a method for obtaining bright zinc and cadmium electroplates and to a novel electroplating additive suitable for this process.

THE PRIOR ART

Conventional methods heretofore employed in the electrodeposition of zinc and cadmium by means of the well known Hull cell method have advantageously employed a number of additives for the purpose of obtaining brighter deposits or of obtaining articles in a more economical manner. Typical examples of such additives are the inner salts of quaternized pyridine carboxylic acid, as described more fully in U.S. Pat. No. 3,411,996 to J. D. Rushmere and made of reference herein; or some specific aldehydes, as described in U.S. Pat. No. 3,088,884 to F. Passal; or organic amine oxides having ≡N→O group, as described in U.S. Pat. No. 3,296,105 to J. D. Rushmere; or products of the reaction between an amine and a halo-epoxy-propane, as described in U.S. Pat. No. 3,803,008 to W. E. Rosenberg et al; or a polyethylenimine as described in U.S. Pat. No. 3,393,135 to W. E. Rosenberg.

It has been found, however, that continuous improvement in the economic aspect of the process as well as in the practical results of the product are needed. The present invention offers a more economical method than anyone heretofore employed, because a lesser amount of additive is required in order to obtain an even brighter plating than heretofore. This and other advantages of the additives of the present invention will become apparent however from the following description thereof.

BRIEF SUMMARY OF THE INVENTION

According to the present invention, the conventional aqueous alkaline electroplating bath containing metal ions selected from the group consisting of zinc and cadmium can be improved by adding thereto a small but efficient amount of a novel inner salt of a quaternized pyridine carboxamide having the general formula

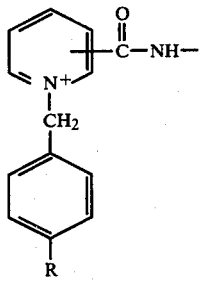

wherein R is hydrogen or a nicotinamide radical, the salt being dissolved therein in an amount to yield a metal deposit of improved brightness.

The invention further comprises the method for electroplating zinc and cadmium from an aqueous, alkaline electroplating bath, which comprises adding to the bath from a small amount such as about 0.01 to saturation, preferably about 10 grams per liter of an inner salt of a quaternized pyridine carboxamide of the above formula. The invention is also directed to an aqueous solution of an addition agent for an electroplating bath containing zinc or cadmium ions and comprising the salt and a bath soluble organic polymer in a ratio of from about 1 to 100 parts by weight of the above mentioned quaternized pyridine carboxamide salt to 100 to 1 parts by weight of said bath soluble organic polymer. A preferred additive is 1-benzyl pyridinium-3-carboxamide and the addition of nicotinamide to a inner salt of the quaternized pyridine carboxamide has been found to increase even further the brightness of the plating and the plating time.

DETAILED DESCRIPTION OF THE INVENTION

The inner salt of the quaternized pyridine carboxamides of the present invention must be soluble in the bath, that is, must have solubility of at least about 0.01 gram per liter at room temperature. The compounds of the present invention may be readily prepared from acids of pyridine, many of which are commercially available, and agents which are usually benzylhalides. For example, nicotinamide

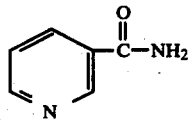

may be reacted stoichiometrically with benzyl chloride

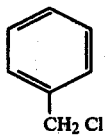

The reaction between these substances is always on a Stoichiometric basis and, therefore, excesses of one reactant or the other are preferably to be avoided. The reaction is carried out in an autoclave or similarly closed vessel, at reflux temperature, namely at boiling, and at atmospheric pressure. It takes about three hours for the reaction to be satisfactorily completed and the reaction is kept on the alkaline side of the pH scale by using, for example, dilute sodium hydroxide. It is permissible, of course, to have a slight excess of benzyl chloride, but this has to be thereafter boiled off, which shows the advantage of using Stoichiometric molar quantities of reactants. The product of the above examplary reaction is

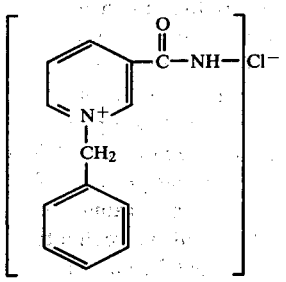

the chloride ion $Cl^-$ being attracted obviously by the positive charge in the molecule. The product of this typical reaction is called 3-amido benzyl pyridinium chloride, or 1-benzyl pyridinium 3-carboxamide chloride, or benzyl nicotinamide ammonium chloride. To verify the presence of free chloride ion ($Cl^-$), which indicates that the reaction went as above described a conventional silver nitrate titration is carried out to check for ionizable chloride and an aniomic-cationic titration as a check for the quaternary salt. These two tests, properly conducted, will verify the existence of the product, which, when used as an additive in the present invention, may be represented by the formula

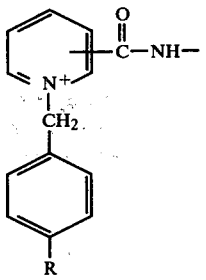

wherein R is hydrogen or a nicotinamide radical. The above illustrative reaction is utilized, mutatis mutandis, when other reactants are used in the preparation of the quaternized pyridine carboxamide salts. The above-given formula indicates implicitly that the + sign stands for the cation terminal, the anion being supplied by the neutralizing NH- radical in the ring. The preferred compound is 1-benzyl pyridinium-3-carboxamide, the reaction for which has been illustratively given hereabove. The additive may be used in combination with organic polymers which are also soluble in the bath. The presence of the polymer may become desirable when the bath is used at temperatures above room temperature. The additive may generally be used alone at a temperature from about 20° C. to 30° C.; however, at higher temperatures, that is from 30° C. to 50° C., it is often desirable to use both the carboxamide and an organic polymer.

Examples of suitable polymers include synthetic polymers such as polyvinyl alcohol and polyethylene amine, and natural polymers such as gelatin, glue, peptone, gum tragacanth, gum arabic, gum ghatti, gum guaiac, and agaragar as well as proteins and substances such as egg albumin and milk protein hydrolysate. The polyvinyl alcohol may be modified for example by a partial ether formed by condensation of ethylene oxide or glycidol. The polyvinyl alcohols prepared by hydrolysis of polyvinyl acetate are a preferred type of organic polymer. Those having average molecular weights from about 5,000 to 20,000 which are either fully hydrolyzed or partially hydrolyzed (87–89%) provide particularly stable plating baths.

The brightening compositions of this invention are preferably used in the form of aqueous solutions of addition agents for the zinc and cadmium plating baths. Additives for the plating baths may be prepared containing carboxamide salt and organic polymer in ratios to each other of from about 1 to 100 to 100 to 1 parts by weight. The addition agent preferably consists of an aqueous solution containing from about 5 to 35% by weight of solids and is added directly to the bath. Preferably, the additive will contain from about 3:1 to 9:1 parts by weight of carboxamide salt to polymer.

In preparing the plating baths, zinc and cadmium ions are made available in the usual manner by adding oxides, hydroxides and cyanides of these metals to the plating bath. In an electroplating bath containing zinc or cadmium, from about 0.01 to saturation and typically to 10 grams per liter of the inner salt of quaternized pyridine carboxamide will be present with from about 0.01 to 10 grams per liter of the organic polymer. The invention will be further illustrated by the following examples in which parts and percentages are by weight, unless otherwise specified.

Very bright plating may be obtained after even shorter periods of plating time, e.g. 5 minutes at up to 150 amperes/sq. ft. by adding to the inner salt of the quaternized pyridine carboxamide from 0.02 to 0.40 grams/liter of solution of nicotinamide.

EXAMPLE 1

In a series of experiments an aqueous plating bath having the following composition was prepared:

| | Grams/liter |
|---|---|
| Sodium cyanide | 40 |
| Sodium hydroxide | 90 |
| Zinc cyanide | 60 |
| Sodium carbonate | 80 |
| Sodium sulfide | 1 |

1-benzyl pyridinium-3-carboxamide, prepared as described earlier, was used as the additive. Sodium hydroxide was added to the reaction mixture to give a pH of between 6.0 and 6.5. The mixture was then refluxed for three hours, cooled and diluted to give a 10% by weight solution which was added to the cyanide plating bath. A steel Hull cell panel was plated at 2 amp. for five minutes in a bath containing 0.25 grams per liter of 1-benzyl pyridinium-3-carboxamide. No washing or dipping in nitric acid to remove stains was found necessary. An extremely bright plate was obtained over a current density range of 0–150 amps per square foot. In a control experiment conducted in the absence of any additive, a uniformly dull plate over the entire face of the panel was obtained (0–150 amps per square foot). Similarly, a comparative experiment using 0.8 grams per liter of 1-benzyl pyridinium-3-carboxalate, under the same operating conditions, required washing and nitric acid dipping in order to obtain an equally acceptable bright plate. The metal distribution of the comparative experiment article was not found to be as good as when using the additive of the present invention.

EXAMPLE 2

Example 1 was repeated except that a series of fan guards were plated successively in the bath to which was added a partially hydrolyzed (87–89%) polyvinyl alcohol having a molecular weight of about 17,000 with the amount of polyvinyl alcohol being increased after each plating operation. The following observations were made on the plated products demonstrating that even very small amounts of polyvinyl alcohol improve the quality of the electroplate over that obtained by either compound alone.

TABLE I

| Test No. | 1-benzyl pyridinium-3-carboxamide added (g/l) | Polyvinyl alcohol added (g/l) | Observations |
|---|---|---|---|
| 1 | 0.5 | 0 | Product bright on all surfaces |
| 2 | 0.5 | 0.004 | Increase in shineness of plate |
| 3 | 0.5 | 0.08 | Plate very bright and shiny |
| 4 | 0.5 | 0.13 | Plate extremely bright even in low current density areas |
| 5 | 0 | 0.13 | Dull all over |

EXAMPLE 3

Example 1 was repeated except that 115 grams per liter of sodium cyanide were used in the bath and 80 grams per liter of cadmium oxide were substituted for the zinc cyanide. A steel Hull cell panel was plated at one amp for five minutes in a cadmium cyanide plating bath containing 0.25 grams per liter of 1-benzyl pyridinium-3-carboxamide. No washing and no dipping in nitric acid were needed to obtain a smooth bright and highly satisfactory plate over the range of 0–150 amps per square foot.

A control panel plated under similar conditions but in the absence of the additive had a dull white plate across the entire face of the panel. Similarly, a comparative experiment using 0.8 grams per liter of 1-benzyl pyridinium-3-carboxalate using the same operating conditions, required washing and nitric acid dipping in order to obtain equivalent acceptable bright plates.

EXAMPLES 4–7

Using the bath compositions of Examples 1 and 3, respectively, and employing a reduced amount of the carboxamide namely 0.15 grams per liter, in conjunction with 0.04 grams per liter and 0.50 grams per liter, respectively, of nicotinamide, the products showed after only five minutes of electroplating at 2 amps a very bright panel at 0–150 amps per square foot and no washing or dipping in nitric acid were found necessary in order to obtain a very smooth and bright plating. Similar results were obtained both at high cyanide and at low cyanide formulations. The results were as follows:

TABLE II

| Test No. | Nicotinamide (g/l) | Plating | Observations |
|---|---|---|---|
| 6 | 0.10 | Zinc | Plates extremely bright, even in low current density areas |
| 7 | 0.05 | Zinc | |
| 8 | 0.125 | Cadmium | |

TABLE II-continued

| Test No. | Nicotinamide (g/l) | Plating | Observations |
|---|---|---|---|
| 9 | 0.02 | Cadmium | |

What we claim and we wish to protect with Letters Patent of the United States is:

1. In an aqueous alkaline electroplating bath containing metal ions selected from the group consisting of zinc and cadmium, the improvement which comprises having present in the bath from about 0.01 grams per liter to saturation of an inner salt of a quaternized pyridine carboxamide having the formula

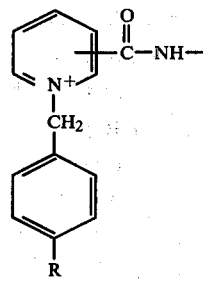

wherein R is hydrogen or a nicotinamide radical, said carboxamide being dissolved in the bath to yield a metal deposit of improved brightness.

2. The electroplating bath of claim 1, wherein said inner salt of quaternized pyridine carboxamide is 1-benzyl pyridinium-3-carboxamide.

3. The electroplating bath of claim 2, wherein said carboxamide is mixed with from 0.02 to 0.40 grams/liter of nicotinamide.

4. The electroplating bath of claim 1, wherein said inner salt of quaternized pyridine carboxamide contains nicotinamide in an amount to give in the bath a quantity of nicotinamide of from about 0.02 to about 0.40 gram/-liter.

5. In the process for electrodepositing a metal from an aqueous alkaline electroplating bath containing metal ions selected from the group consisting of zinc and cadmium, the improvement which comprises adding to said bath from about 0.1 to about 10 grams per liter of an inner salt of a quaternized pyridine carboxamide having the formula

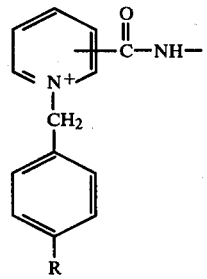

wherein R is hydrogen or a nicotinamide radical, said carboxamide being dissolved in the bath to yield a metal deposit of improved brightness.

6. The process of claim 5, wherein said inner salt of quaternized pyridine carboxamide is 1-benzyl pyridinium-3-carboxamide.

7. The process of claim 6, wherein said carboxamide is combined with from 0.01 to 0.50 grams/liter of nicotinamide.

8. The process of claim 7, wherein the bath soluble organic polymer is a polyvinyl alcohol having a molecular weight between 5,000 and 20,000.

9. The process of claim 5, wherein said nicotinamide is added in an amount of from about 0.01 to about 0.50 grams/liter.

10. The process of claim 9, wherein a bath soluble organic polymer is present in the bath in an amount from about 0.01 to about 10 grams per liter.

11. The process of claim 5, wherein a bath soluble organic polymer is present in the bath in an amount from about 0.01 to about 10 grams per liter.

12. An aqueous addition agent for an electroplating bath containing metal ions selected from the group consisting of zinc and cadmium, said agent consisting essentially of an aqueous solution consisting essentially of (a) from about 1:100 to 100:1 parts by weight of an inner salt of a quaternized pyridine carboxamide having the formula:

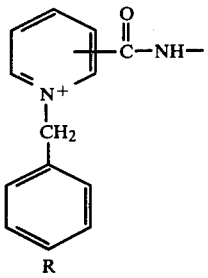

wherein R is hydrogen or a nicotinamide radical, and (b) a bath soluble organic polymer, in a ratio of (a): (b), in parts by weight, of from about 1:100 to about 100:1.

13. The addition agent of claim 12, wherein said addition agent contains nicotinamide in an amount to yield in the electroplating bath from about 0.01 to about 0.50 grams of nicotinamide per liter of bath solution.

14. The addition agent of claim 12, wherein said inner salt of quaternized pyridine carboxamide is 1-benzyl pyridinium-3-carboxamide and the bath soluble organic polymer is a polyvinyl alcohol having a molecular weight between 5,000 and 20,000.

15. The addition agent of claim 14, wherein the composition contains from about 3:1 to about 9:1 parts by weight of said 1-benzyl pyridinium-3carboxamide to said polyvinyl alcohol.

* * * * *